US007459867B1

(12) United States Patent
Yu et al.

(10) Patent No.: US 7,459,867 B1
(45) Date of Patent: Dec. 2, 2008

(54) PROGRAM START BALLAST

(75) Inventors: Qinghong Yu, Waltham, MA (US); Kaiyu Wang, Peabody, MA (US)

(73) Assignee: Osram Sylvania Inc., Danvers, MA (US)

( * ) Notice: Subject to any disclaimer, the term of this patent is extended or adjusted under 35 U.S.C. 154(b) by 84 days.

(21) Appl. No.: 11/747,558

(22) Filed: May 11, 2007

(51) Int. Cl.
*G05F 1/00* (2006.01)

(52) U.S. Cl. ..... 315/307; 315/244; 315/224; 315/360; 315/209 R; 315/128; 315/DIG. 5; 315/DIG. 7

(58) Field of Classification Search ..... 315/209 R, 315/224, 244, 119, 127, 128, 294, 307, 291, 315/312, 324, 325, 360, DIG. 5, DIG. 7
See application file for complete search history.

(56) References Cited

U.S. PATENT DOCUMENTS 5,049,790 A * 9/1991 Herfurth et al. ..... 315/291
5,650,694 A * 7/1997 Jayaraman et al. ..... 315/225
5,945,788 A * 8/1999 Li et al. ..... 315/308
6,720,739 B2 * 4/2004 Konopka ..... 315/225
7,312,588 B1 * 12/2007 Yu et al. ..... 315/291

* cited by examiner

*Primary Examiner*—Haissa Philogene
(74) *Attorney, Agent, or Firm*—Carlo S. Bessone

(57) ABSTRACT

A ballast (10) for powering at least one gas discharge lamp (70) in a program start mode comprises an inverter (200), a resonant output circuit (400), and a control circuit (600). During operation of ballast (10), control circuit (600) monitors a voltage within resonant output circuit (400). When the monitored voltage reaches a first specified level that is indicative of sufficient filament preheating, control circuit (600) maintains the inverter operating frequency at a first present value for a preheating period so as to provide preheating of lamp filaments (72,74). Following completion of the preheating period, control circuit (600) allows the inverter operating frequency to decrease. When the monitored voltage reaches a second specified level that is indicative of sufficient ignition voltage, control circuit (600) maintains the inverter operating frequency at a second present value for an ignition period so as to provide ignition of lamp (70).

24 Claims, 2 Drawing Sheets

PROGRAM START BALLAST

FIELD OF THE INVENTION

The present invention relates to the general subject of circuits for powering discharge lamps. More particularly, the present invention relates to a ballast for providing program start operation of one or more gas discharge lamps.

BACKGROUND OF THE INVENTION

Electronic ballasts for gas discharge lamps are often classified into two groups—preheat type and instant start type—according to how the lamps are ignited. In preheat type ballasts, the lamp filaments are initially preheated at a relatively high level (e.g., 7 volts peak) for a limited period of time (e.g., one second or less) before a moderately high voltage (e.g., 500 volts peak) is applied across the lamps in order to ignite the lamps. In instant start ballasts, the lamp filaments are not preheated, so a significantly higher starting voltage (e.g., 1000 volts peak) is required in order to ignite the lamps. It is generally acknowledged that instant start type operation offers certain advantages, such as the ability to ignite the lamps at a lower ambient temperature and greater energy efficiency (i.e., greater light output per watt) due to no expenditure of power on filament heating during normal operation of the lamps. On the other hand, preheat type operation usually results in considerably greater lamp life than instant start type operation.

Within the group of ballasts that are classified as preheat type ballasts, there are two main categories—rapid start ballasts and program start ballasts. Program start ballasts are generally preferred over rapid start ballasts, mainly due to the fact that the amount of energy that is expended upon heating the lamp filaments during normal operation is generally significantly reduced in those types of ballasts.

Preheat type ballasts typically include one or more resonant output circuits. The one or more resonant output circuits serve to provide a number of functions, such as preheating of the lamp filaments, providing a high voltage for igniting the lamp(s), and supplying a magnitude-limited current for powering the lamp(s) during steady-state operation. In order to preserve and optimize the useful operating lives of the lamps, it is important for the ballast to provide the lamps with appropriate levels of filament preheating and with an appropriately high ignition voltage for igniting the lamps.

Program start ballasts typically employ a circuit that includes a high frequency inverter and a resonant output circuit. As is known to those skilled in the art, the effective resonant frequency of a resonant circuit is dependent upon certain parameters, including the inductance of the resonant inductor and the capacitance of the resonant capacitor. In practice, those parameters are subject to component tolerances, and may vary by a considerable amount. Additionally, the effective resonant frequency of a resonant circuit is also influenced by the lead lengths and/or the nature of the electrical wiring that connects the ballast to the lamp(s); the electrical wiring introduces parasitic capacitance (also referred to as "stray capacitance") which effectively alters the effective resonant frequency of the resonant circuit(s), and which therefore affect the magnitudes of the preheating and ignition voltages provided by the ballast to the lamp(s). Such parameter variation makes it difficult and/or impractical to pre-specify (i.e., on a priori basis) an operating frequency of the inverter so as to ensure that suitable preheating and ignition voltages are provided to the lamp(s).

The aforementioned difficulties arising from parameter variation are even more problematic when the ballast includes multiple resonant circuits and/or when the wiring between the ballast output connections and the lamps has a considerable length; in the latter case, the resulting parasitic capacitance becomes a very significant factor. Accordingly, for a given predefined inverter operating frequency, the magnitudes of the filament preheating and ignition voltages that are provided by a resonant output circuit may vary considerably, and may, in some instances, prove to be either insufficient or at least considerably less than ideal, for preheating and igniting the lamp in a desired manner.

Thus, a need exists for a program start type ballast that is capable of compensating for the parameter variations that affect a resonant output circuit, so as to ensure that the ballast provides both an appropriate level of preheating for the lamp filaments, as well as a sufficiently high ignition voltage for igniting the lamp(s). A ballast with such capabilities, and that is capable of being realized in a convenient and cost-effective manner, would represent a considerable advance over the prior art.

DETAILED DESCRIPTION OF THE PREFERRED EMBODIMENTS

Figure 1:
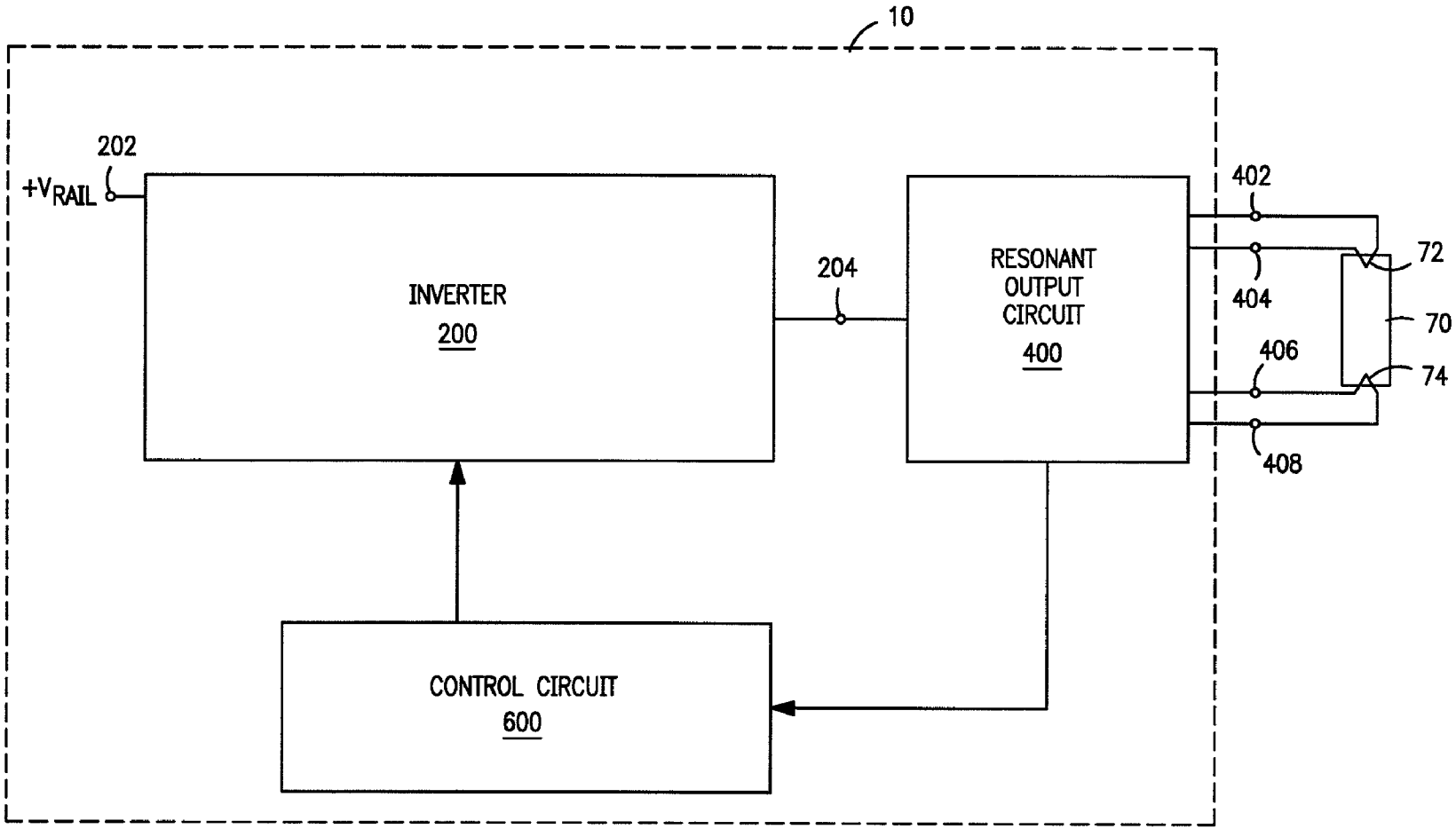
FIG. 1 is a block electrical diagram of a program start ballast for powering a gas discharge lamp, in accordance with a preferred embodiment of the present invention.

FIG. 1 describes a ballast 10 for powering a gas discharge lamp 70 having a pair of filaments 72,74. Ballast 10 comprises an inverter 200, a resonant output circuit 400, and a control circuit 600.

Inverter 200 includes an input 202 and an inverter output terminal 204. During operation, inverter 200 receives, via input 202, a substantially direct current (DC) voltage, $V_{RAIL}$. $V_{RAIL}$ is typically provided by suitable rectification circuitry (e.g., a combination of a full-wave bridge rectifier and a power factor correcting DC-to-DC converter, such as a boost converter) which receives power from conventional alternating current (AC) voltage source (e.g., 120 volts rms or 277 volts rms, at 60 hertz). During operation of ballast 10, inverter 200 provides, at inverter output terminal 204 (and taken with respect to a circuit ground), an inverter output voltage having an operating frequency that is typically selected to be greater than about 20,000 hertz.

Resonant output circuit 400 is coupled between inverter output terminal 204 and lamp 70. Resonant output circuit 400 includes output connections 402,404,406,408 adapted for coupling to lamp 70. During operation of ballast 10, resonant output circuit 400 provides: (i) preheating of lamp filaments 72,74; (ii) an ignition voltage for igniting lamp 70; and (iii) a magnitude-limited current for operating lamp 70.

Control circuit 600 is coupled to inverter 200 and to resonant output circuit 400. During operation of ballast 10, control circuit 600 monitors a voltage within resonant output circuit 400. In response to the monitored voltage reaching a first specified level, indicating that the filament voltages (e.g., the voltage between output connections 402 and 404, and the voltage between output connections 406 and 408) have attained magnitudes that are sufficient for properly preheating filaments 72,74 of lamp 70, control circuit 600 directs inverter 200 to maintain its operating frequency at a first present value for a predetermined preheating period. By maintaining the operating frequency at the first present value for a specified period of time, control circuit 600 allows resonant circuit 400 to maintain, for the preheating period, the filament voltages at a suitable level for properly and sufficiently heating filaments 72,74. Upon completion of the preheating period, control circuit 600 allows the operating frequency of inverter 200 to decrease from the first present value.

As the operating frequency of inverter 200 decreases from the first present value, the monitored voltage (within resonant output circuit 400) increases until it reaches a second specified level, indicating that the ignition voltage (i.e., the voltage that exists between each of the pairs 402,404 and 406,408 of the output connections) has attained a magnitude that is sufficient for properly igniting lamp 70. At that point, control circuit 600 directs inverter 200 to maintain its operating frequency at a second present value for a predetermined ignition period. By maintaining the operating frequency at the second present value, control circuit 600 allows resonant output circuit 400 to maintain, for the predetermined ignition period, the ignition voltage at a level that is suitable for igniting lamp 70 in a manner that is reliable and that is conducive to optimizing the useful operating life of lamp 70.

Thus, control circuit 600 operates to select appropriate operating frequencies (i.e., during the preheating period and during the ignition period) for inverter 200 so as to ensure that the lamp filaments are sufficiently preheated and that a proper ignition voltage is provided for properly and reliably igniting the lamp.

Preferred circuitry for realizing ballast 10 is now described with reference to FIG. 2.

Figure 2:
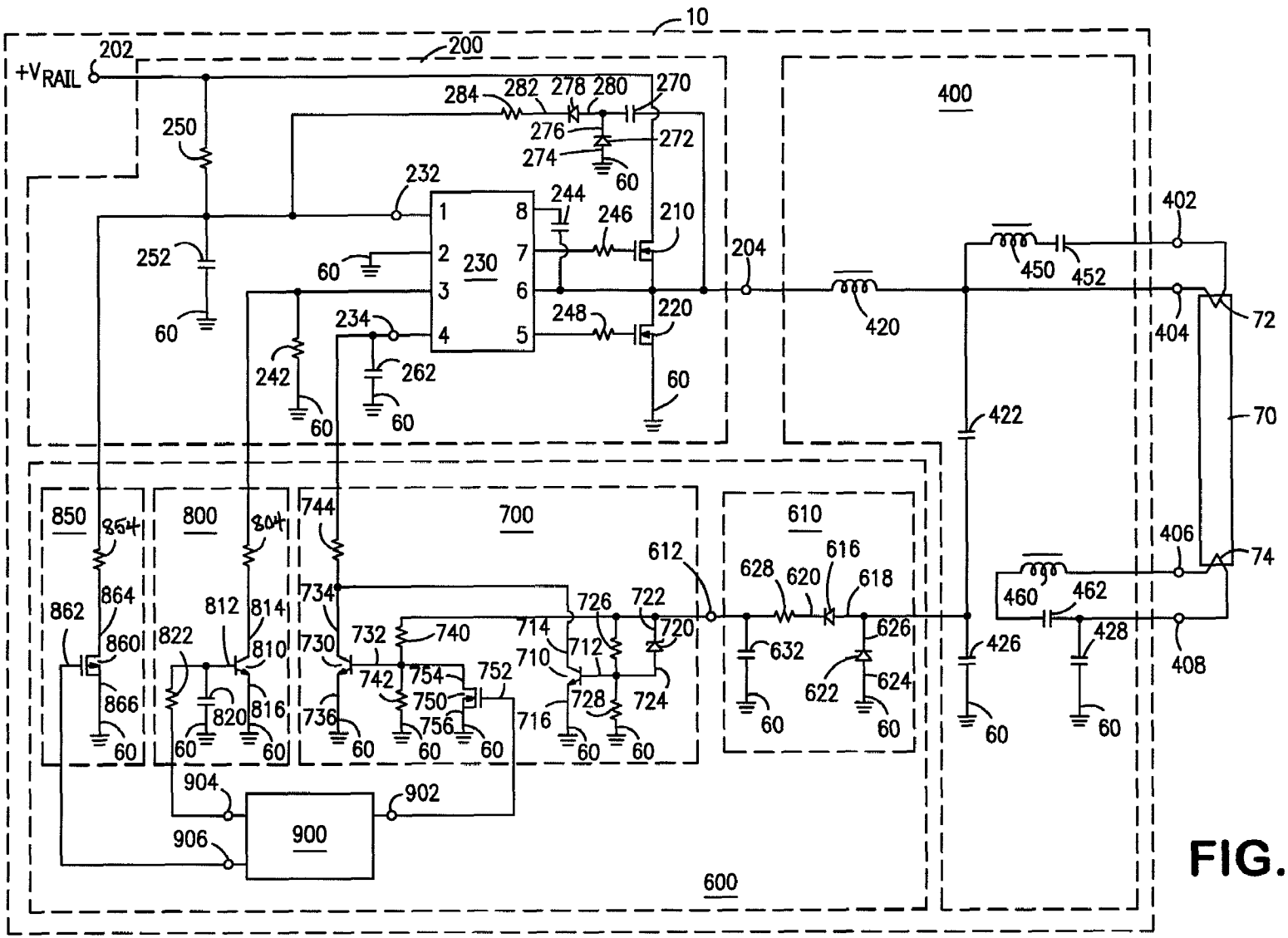
FIG. 2 is a detailed electrical diagram of a program start ballast for powering a gas discharge lamp, in accordance with a preferred embodiment of the present invention.

As described in to FIG. 2, output circuit 400 is preferably realized as a parallel-loaded series-resonant type output circuit that includes first, second, third, and fourth output connections 402,404,406,408, a resonant inductor (comprising a primary winding 420, a first secondary winding 450, and a second secondary winding 460, wherein secondary windings 450,460 are understood to be magnetically coupled to primary winding 420), a resonant capacitor 422, a voltage-divider capacitor 426, a direct current (DC) blocking capacitor 428, a first filament capacitor 452, and a second filament capacitor 462. First and second output connections 402,404 are adapted for coupling to a first filament 72 of lamp 70, while third and fourth output connections 406,408 are adapted for coupling a second filament 74 of lamp 70. Primary winding 420 (of the resonant inductor) is coupled between inverter output terminal 204 and second output connection 404. First filament capacitor 452 is coupled in series with first secondary winding 450, and the series combination of first filament capacitor 452 and first secondary winding 450 is coupled between first and second output connections 402,404. Second filament capacitor 462 is coupled in series with second secondary winding 460, and the series combination of second filament capacitor 462 and second secondary winding 460 is coupled between third and fourth output connections 406,408. Resonant capacitor 422 is coupled to second output connection 404, while voltage divider capacitor 426 is coupled between resonant capacitor 422 and circuit ground 60; it will be appreciated by those skilled in the art that the effective resonant capacitance of output circuit 400 is equal to the equivalent capacitance of the series combination of resonant capacitor 422 and voltage-divider capacitor 426. DC blocking capacitor 428 is coupled between fourth output connection 408 and circuit ground 60.

During operation of ballast 10, output circuit 400 receives the inverter output voltage (via inverter output terminal 204) and provides (via output connections 402,404,406,408) voltages for heating lamp filaments 72,74, a high voltage for igniting lamp 70, and a magnitude-limited current for operating lamp 70. By way of example, if lamp 70 is realized as a T8 type lamp, the voltages for heating filaments 72,74 are typically selected to be on the order of about 3.5 volts rms, the high voltage for igniting lamp 70 is typically selected to be on the order of about 600 volts rms, and the magnitude-limited operating current is typically selected to be on the order of about 180 milliamperes.

As depicted in FIG. 2, inverter 200 is preferably realized as a driven half-bridge type inverter that includes input 202, inverter output terminal 204, first and second inverter switches 210,220, and an inverter driver circuit 230. As previously recited, input 202 is adapted for receiving a source of substantially DC voltage, $V_{RAIL}$. First and second inverter switches 210,220 are preferably realized by N-channel field-effect transistors (FETs). Inverter driver circuit 230 is coupled to inverter FETs 210,220, and may be realized by any of a number of available devices; preferably, inverter driver circuit 230 is realized by a suitable integrated circuit (IC) device, such as the IR2520 high-side driver IC manufactured by International Rectifier, Inc.

During operation of ballast 20, inverter driver circuit 230 commutates inverter FETs 210,220 in a substantially complementary manner (i.e., such that when FET 210 is on, FET 220 is off, and vice-versa) to provide a substantially squarewave voltage between inverter output terminal 204 and circuit ground 60. Inverter driver circuit 230 includes a DC supply input 232 (pin 1 of 230) and a voltage controlled oscillator (VCO) input 234 (pin 4 of 230). DC supply input 232 receives operating current (i.e., for powering inverter driver circuit 230) from a DC voltage supply, $+V_{CC}$, that is typically selected to provided a voltage that is on the order of about +15 volts. The operating frequency of inverter 200 is set in dependence upon a voltage provided to VCO input 234. More specifically, the instantaneous voltage that is present at VCO input 234 determines the instantaneous frequency at which inverter driver circuit 230 commutates inverter transistors 210,220; in particular, the frequency decreases as the voltage at VCO input 234 increases. It will be understood by those skilled in the art that the instantaneous frequency at which inverter driver circuit 230 commutates inverter transistors 210,220 is the same as the fundamental frequency (referred to herein as the "operating frequency") of the inverter output voltage provided between inverter output terminal 204 and circuit ground 60. Other components associated with inverter driver circuit 230 include capacitors 244,262 and resistors 242,246,248, the functions of which are known to those skilled in the art.

Advantageously, ballast 10 monitors the voltage across voltage-divider capacitor 426 and, by controlling the operating frequency of inverter 200, ensures that sufficient voltages are provided for preheating lamp filaments 72,74 and for properly igniting lamp 70. It will be appreciated that the voltage across voltage-divider capacitor 426 is representative of the voltages that are provided for preheating filaments 72,74 and for igniting lamp 70, and are thus indicative of whether or not appropriate voltages are being provided for properly preheating filaments 72,74 and for properly igniting lamp 70. Moreover, control circuit 600 ensures that the preheating and ignition voltages are supplied for specified periods of time, as dictated by applicable standards and by the goal of optimizing the useful operating life of lamp 70.

As previously recited, control circuit 600 allows the inverter operating frequency to decrease until such time as the monitored voltage (i.e., the voltage across voltage-divider capacitor 426) reaches either of two specified levels. When the monitored voltage reaches the first specified level, control circuit 600 maintains the operating frequency at the first present level (thereby ensuring that filament heating voltages will be provided at a desired level) for a predetermined preheating period, so as to give filaments 72,74 sufficient heating time prior to attempting to ignite lamp 70. After completion of the preheating period, control circuit 600 allows the inverter operating frequency to decrease until such time as the monitored voltage reaches the second specified level, at which point control circuit 600 maintains the operating frequency at the second present level (thereby ensuring that the ignition voltage which exists between each of the pairs of output connections 402,404 and 406,408 is at a sufficiently high level to reliably ignite lamp 70) for a predetermined ignition, so as to give lamp 70 a sufficient opportunity to properly ignite. In this way, ballast 10 automatically compensates for parameter variations within output circuit 400 (due to variations in the values of the resonant circuit components or due to parasitic capacitances attributable to the wiring between ballast output connections 402,404,406,408 and lamp 70), and thus ensures that suitable voltages are provided for properly and reliably preheating filaments 72,74 and igniting lamp 70.

Preferred circuitry for implementing inverter 200 and control circuit 600 is now described with reference to FIG. 2 as follows.

As depicted in FIG. 2, inverter 200 preferably further includes a startup circuit and a bootstrap supply circuit.

The startup circuit, which serves to provide power for initially activating inverter driver circuit 230, preferably comprises a startup resistor 250 and a supply capacitor 252. Startup resistor 250 is coupled between $+V_{RAIL}$ and DC supply input 232 of inverter driver circuit 230. Supply capacitor 252 is coupled between DC supply input 232 and circuit ground 60. During operation, after power is initially applied to ballast 10, supply capacitor 252 charges up (via resistor 250) from the voltage $+V_{RAIL}$. When the voltage across capacitor 252 reaches a sufficient level (i.e., the required startup voltage for inverter driver circuit 230), inverter driver circuit 230 begins to operate and provide inverter switching.

The bootstrap supply circuit, which serves to provide steady-state operating power to inverter driver circuit 230, preferably comprises a coupling capacitor 270, a first diode 272, a second diode 278, and a resistor 284. Coupling capacitor 270 is coupled to inverter output terminal 204. First diode 272 has an anode 274 coupled to circuit ground 60, and a cathode 276 coupled to coupling capacitor 270. Second diode 278 has an anode 280 and a cathode 282; anode 280 is coupled to cathode 276 of first diode 272. Resistor 284 is coupled between cathode 282 of second diode 278 and DC supply input 232 of inverter driver circuit 230. During operation, when inverter 200 is operating, the bootstrap supply circuit functions as a sort of half-wave rectifier circuit to maintain the voltage across supply capacitor 252 (which is the same as the voltage between DC supply 232 and circuit ground 60) at a level that is necessary for maintaining operation of inverter driver circuit 230.

In a preferred embodiment of ballast 10, as illustrated in FIG. 2, control circuit 600 includes a voltage detection circuit 610, a frequency-hold circuit 700, and a timing control circuit 900. Preferred structures for realizing voltage detection circuit 610, frequency-hold circuit 700, and timing control circuit 900, as well as various operational details of those circuits, are described as follows.

Voltage detection circuit 610 is coupled to resonant output circuit 400, and includes a detection output 612. During operation, voltage detection circuit 610 serves to provide a first detection signal and a second detection signal at detection output 612 in response to the monitored voltage (i.e., the voltage across capacitor 426) reaching the first and second specified levels. More specifically: (i) when the monitored voltage reaches the first specified level (i.e., indicating the provision of appropriate voltages for preheating filaments 72,74), voltage detection circuit 610 provides the first detection signal (having a relatively low magnitude) at detection output 612; and (ii) when the monitored voltage reaches the second specified level (i.e., indicating the provision of an appropriate voltage for igniting lamp 70), voltage detection circuit 610 provides the second detection signal (having a relatively high magnitude) at detection output 612. The monitored voltage is simply a scaled-down version of the voltage across resonant capacitor 422, and that voltage is indicative of both the filament heating voltages and the ignition voltage. Thus, the monitored voltage being at the specified levels corresponds to the filament preheating and ignition voltages being at their desired levels.

In a preferred embodiment of ballast 10, as described in FIG. 2, voltage detection circuit 610 comprises a first diode 616, a second diode 622, and a low-pass filter comprising a filter resistor 628 and a filter capacitor 632. First diode 616 has an anode 618 and a cathode 620. Second diode 622 has an anode 624 and a cathode 626. Anode 618 of first diode 616 is coupled to cathode 626 of second diode 622. Anode 624 of second diode 622 is coupled to circuit ground 60. Filter resistor 628 is coupled between cathode 620 of first diode 616 and detection output 612. Filter capacitor 632 is coupled between detection output 612 and circuit ground 60.

During operation of ballast 10 and voltage detection circuit 610, the voltage that develops across filter capacitor 632 (and thus at detection output 612) is simply a scaled-down and filtered version of the positive half-cycles of the voltage across voltage-divider capacitor 426. Filter resistor 628 and filter capacitor 632 serve to suppress any high frequency components present in the monitored voltage.

Frequency-hold circuit 700 is coupled between detection output 612 of voltage detection circuit 610 and VCO input 234 of inverter driver circuit 230. During operation, and in response to either the first detection signal or the second detection signal being present at detection output 612 (thereby indicating that either the filament preheating voltages or the ignition voltage have attained a sufficiently high level), frequency-hold circuit 700 substantially maintains the voltage provided to VCO input 234 at a certain value (i.e., at either a first or a second value) for a predetermined period of time (i.e., for either the filament preheating period of for the ignition period). By maintaining the voltage at VCO input 234 at a corresponding present level, the operating frequency of inverter 200 is correspondingly maintained at or near an appropriate level (accounting for any parameter variations due to component tolerances or wiring capacitances), thereby maintaining suitable voltages for preheating the filaments of, and for properly igniting, lamp 70.

More specifically: (i) in response to the first detection signal being present at detection output 612 (which indicates that the filament preheating voltages have attained a sufficiently high level), frequency-hold circuit 700 substantially maintains the voltage provided to VCO input 234 at a first value for the duration of the preheating period; and (ii) in response to the second detection signal being present at detection output 612 (which indicates that the ignition voltage has attained a sufficiently high level), frequency-hold circuit 700 substantially maintains the voltage provided to VCO input 234 at a second value for the duration of the ignition period.

As described in FIG. 2, frequency-hold circuit 700 preferably comprises a first electronic switch 730, a second electronic switch 750, a third electronic switch 710, a pull-down resistor 744, and first, second, third, and fourth resistors 740, 742,726,728. First electronic switch 730 has a base 732, a collector 734, and an emitter 736; emitter 736 is coupled to circuit ground 60. Second electronic switch 750 has a gate 752, a drain 754, and a source 756; drain 754 is coupled to base 732 of first electronic switch 730, and source 756 is coupled to circuit ground 60. Third electronic switch 710 has a base 712, a collector 714, and an emitter 716; collector 714 is coupled to collector 734 of first electronic switch 730, and emitter 716 is coupled to circuit ground 60. Pull-down resistor 744 is coupled between VCO input 234 of inverter driver circuit 230 and collector 734 of first electronic switch 730. First resistor 740 is coupled between detection output 612 (of voltage detection circuit 610) and base 732 of first electronic switch 730. Second resistor 742 is coupled between base 732 of first electronic switch 730 and circuit ground 60. Third resistor 726 is coupled between detection output 612 (of voltage detection circuit 610) and base 712 of third electronic switch 710. Fourth resistor 728 is coupled between base 712 of third electronic switch 710 and circuit ground 60.

Preferably, and as depicted in FIG. 2, first electronic switch 730 and third electronic switch 710 are each realized by a NPN bipolar junction transistor (BJT). Second electronic switch 750 is preferably realized by a N-channel field-effect transistor (FET). Additionally, it is preferred that frequency-hold circuit 700 further comprise a zener diode 720 that is coupled in parallel with third resistor 726. More particularly, zener diode 720 has a cathode 722 coupled to detection output 612 (of voltage detection circuit 610) and an anode 724 coupled to base 712 of third electronic switch 710. Zener diode 720 is preferably included in frequency-hold circuit 700 in order to ensure that third electronic switch 710 is not activated until such time as the second detection signal (i.e., indicating that an ignition voltage of sufficient magnitude is being provided by resonant output circuit 400) is provided at detection output 612.

During operation of ballast 10, and within frequency-hold circuit 700, BJT 730 is activated when the voltage signal at detection output 612 indicates that the monitored voltage has reached the first specified level; accordingly, resistors 740, 742 are sized so as to activate BJT 730 when the voltage at detection output 612 reaches the first specified level. With BJT 730 turned on, VCO input 234 of inverter driver circuit 230 is essentially coupled to circuit ground 60 via pull-down resistor 744 so as to temporarily prevent any further increase in the voltage at VCO input 234. Consequently, the voltage at VCO input 234 is essentially maintained at a first present level (thereby causing the inverter operating frequency to be essentially maintained at the first present value) for as long as BJT 730 remains turned on (i.e., for the duration of the filament preheating period).

BJT 730 is turned off (thereby terminating the filament preheating period) when timing control circuit 900 provides the preheat control signal at first output 902. More particularly, FET 750 is activated when timing control circuit 900 provides the preheat control signal at first output 902. With FET 750 turned on, base 732 of BJT 730 is coupled to circuit ground 60, thereby deactivating BJT 730. With BJT 730 turned off, the voltage at VCO input 234 of inverter driver circuit 230 is allowed to continue to increase (and thereby continue to decrease the operating frequency of inverter 200).

As the operating frequency of inverter 200 decreases after completion of the filament heating period, the monitored voltage across capacitor 426 increases. When the monitored voltage reaches the second specified level, BJT 710 is activated; accordingly, resistors 726,728 are sized so as to activate BJT 710 when the voltage at detection output 612 reaches the second specified level. With BJT 710 turned on, VCO input 234 is again essentially coupled to circuit ground 60 via pull-down resistor 744 so as to temporarily prevent any further increase in the voltage at VCO input 234. Consequently, the voltage at VCO input 234 is essentially maintained at the second present level (thereby causing the inverter operating frequency to be essentially maintained at the second present value) for as long as BJT 710 remains turned on (i.e., for the duration of the ignition period).

Once lamp 70 ignites and begins to conduct current, the monitored voltage (across capacitor 426) substantially decreases (from the second specified level) by virtue of the "loading" effect that an ignited/operating lamp exerts upon the voltage response of resonant output circuit 400. At that point in time, the voltage signal at detection output 612 reverts to a level that is insufficient to maintain conduction of BJT 710; consequently, BJT 710 turns off. With BJT 710 turned off, the voltage at VCO input 234 is allowed to increase, thereby decreasing the operating frequency of inverter 200.

Timing control circuit 900 includes at least a first output 902 coupled to frequency-hold circuit 700. During operation of ballast 10, timing control circuit 900 provides a preheat control signal at first output 902 upon completion of the preheating period. The preheat control signal is used by frequency-hold circuit 700 (i.e., as a drive signal to gate 752 of FET 750) to indicate that the preheating period has been completed, and to allow the inverter operating frequency to decrease for purposes of generating an ignition voltage for igniting lamp 70.

Timing control circuit 900 is preferably realized as a programmable microcontroller, which may be implemented by a suitable integrated circuit, such as Part No. PIC10F510 (manufactured by Microchip, Inc.), which provides the advantages of relatively low cost and low operating power requirements. During operation, microcontroller 900 serves to control, according to internal timing functions (which are programmed into microcontroller 900), the timing and activation of frequency-hold circuit 700 with reference to the preheating period.

Preferably, and as described in FIG. 2, microcontroller 900 further comprises a second output 904 and a third output 906. Second output 904 of timing control circuit 900 is provided for purposes of supplying a current control signal (a preferred use of which is described in further detail herein). Third output 906 of timing control circuit 900 is provided for purposes of supplying a shutdown control signal (a preferred use of which is described in further detail herein). Additionally, inverter driver circuit 230 preferably further comprises a frequency control input (i.e., pin 3 of inverter driver circuit 230).

Control circuit 600 preferably further comprises an inverter shutdown circuit 850 and a lamp current control circuit 800. Preferred structures and/or pertinent operational details regarding inverter shutdown circuit 850 and lamp current control circuit 800 are now described with reference to FIG. 2 as follows.

In a preferred embodiment of ballast 10, inverter shutdown circuit 850 is coupled between third output 906 of microcontroller 900 and DC supply input 232 of inverter driver circuit 230. As described in FIG. 2, inverter shutdown circuit 850 comprises an electronic switch 860 and a resistor 854. Electronic switch 860 (which is preferably realized by a P-channel field-effect transistor) has a gate 862, a drain 864, and a source 866; gate 862 is coupled to third output 906 of microcontroller 900, and source 866 is coupled to circuit ground 60. Resistor 854 is coupled between DC supply input 232 of inverter driver circuit 230 and drain 864 of FET 860. Resistor 854 is sized (e.g., 100 ohms or so) to ensure that the current drain from DC supply input 232 to circuit ground 60 is substantially more than the bootstrap supply circuit can provide, while still being within the pulse current rating of FET 860.

During operation of ballast 10, when a shutdown control signal is provided at third output 906 of microcontroller 900 (in response to a lamp fault condition, etc.), inverter shutdown circuit 850 operates to deactivate inverter driver circuit 230. More particularly, when FET 860 is activated (by a shutdown signal from microcontroller 900), DC supply input 232 of inverter driver circuit 230 is effectively coupled to circuit ground 60 via resistor 854. Consequently, the stored charge in supply capacitor 252 is depleted (via current discharge through resistor 854), causing the voltage at DC supply input 232 to decrease. When the voltage at DC supply input 232 falls below the undervoltage threshold (for the device used to realize inverter driver circuit 230), inverter driver circuit 230 is deactivates and inverter 200 ceases to operate. Inverter driver circuit 230 then remains deactivated for as long as FET 860 remains on.

When the shutdown signal (i.e., as provided at third output 906 of microcontroller 900) is terminated (e.g., following correction of a lamp fault condition, etc.), inverter shutdown circuit 850 allows inverter driver circuit 230 to be reactivated, thereby avoiding any need for cycling of the input power to ballast 10 in order to resume normal operation following correction of any condition that originally necessitated the deactivation of inverter driver circuit 230.

In a preferred embodiment of ballast 10, lamp current control circuit 800 is coupled between second output 904 of microcontroller 900 and frequency control input (pin 3) of inverter driver circuit 230. As described in FIG. 2, lamp current control circuit comprises an electronic switch 810, a first resistor 804, a second resistor 822, and a capacitor 820. Electronic switch 810, which is preferably realized by a NPN bipolar junction transistor (BJT), has a base 812, a collector 814, and an emitter 816; base 812 is coupled to second output 904 of microcontroller 900, and emitter 816 is coupled to circuit ground. First resistor 804 is coupled between frequency control input (i.e., pin 3) of inverter driver circuit 230 and collector 814 of BJT 810. Second resistor 822 and capacitor 820 are each coupled between base 812 of BJT 810 and circuit ground 60.

During operation of ballast 10, when a current control signal is provided at second output 904 of microcontroller 900 (in response to, e.g., a dimming command for reducing the operating current, and correspondingly the light output, of lamp 70), lamp current control circuit 800 operates to effectuate a change in the operating frequency of inverter 200. More specifically, the current control signal activates BJT 810 and effectively places resistor 804 in parallel with resistor 242, thereby reducing the equivalent resistance that is present between frequency control input (i.e., pin 3 of inverter driver circuit 230) and circuit ground 60. Consequently, and as will be understood by those skilled in the art, the operating frequency of inverter 200 is increased, with a corresponding decrease in the operating current that is provided to lamp 70.

Ballast 10 thus provides an economical and reliable solution to the problem of operating a lamp in a program start mode. Ballast 10 accomplishes this by automatically compensating for parameter variations in the resonant output circuit (due to component tolerances and/or attributable to parasitic capacitances due to output wiring), thereby providing appropriate filament heating and ignition voltages for lamp 70 in a manner that is reliable and that preserves the useful operating life of the lamp. Additionally, ballast 10 provides a flexible platform for accommodating additional features, such as lamp fault protection and lamp current control, which may be realized in a convenient and cost-effective manner.

Although the present invention has been described with reference to certain preferred embodiments, numerous modifications and variations can be made by those skilled in the art without departing from the novel spirit and scope of this invention. For instance, although the specific preferred embodiment described herein is directed to a ballast for powering one gas discharge lamp, it will be understood by those skilled in the art that the principles of the present invention may be readily modified for application to ballasts for powering two or more gas discharge lamps, as well as to output circuits that include multiple resonant circuits. Additionally, and as will be appreciated by those skilled in the art, control circuit 600 and timing control circuit 900 may be adapted to provide various additional features, such as lamp fault protection; for example, timing control circuit 900 may be modified to include one or more inputs, along with associated peripheral circuitry, for monitoring the voltages across DC blocking capacitor 428 and the voltage at detection output 612 for indications of a lamp fault condition.

What is claimed is:

1. A ballast for powering at least one gas discharge lamp having a pair of lamp filaments, the ballast comprising:

an inverter having an inverter output terminal and being operable to provide, at the inverter output terminal, an inverter output voltage having an operating frequency;

a resonant output circuit coupled between the inverter output terminal and the lamp, and operable to provide: (i) preheating of the lamp filaments; (ii) an ignition voltage for igniting the lamp; and (iii) a magnitude-limited current for operating the lamp;

a control circuit coupled to the output circuit and the inverter, wherein the control circuit is operable:

(a) to monitor a voltage within the resonant output circuit;

(b) in response to the monitored voltage reaching a first specified level, to control the inverter to maintain its operating frequency at a first present value for a predetermined preheating period so as to allow the resonant output circuit to provide preheating of the lamp filaments during the preheating period;

(c) upon completion of the preheating period, to allow the operating frequency of the inverter to decrease from the first present value; and (d) in response to the monitored voltage reaching a second specified level, to control the inverter to maintain its operating frequency at a second present value for a predetermined ignition period so as to allow the resonant output circuit to provide an ignition voltage for igniting the lamp.

2. The ballast of claim 1, wherein the resonant output circuit comprises a parallel-loaded series-resonant type output circuit.

3. The ballast of claim 2, wherein the resonant output circuit comprises:

first and second output connections adapted for coupling to a first filament of the lamp;

third and fourth output connections adapted for coupling to a second filament of the lamp;

a resonant inductor, comprising a primary winding, a first secondary winding, and a second secondary winding, wherein the primary winding is coupled between the inverter and the second output connection;

a resonant capacitor coupled to the second output connection;

a voltage-divider capacitor coupled between the resonant capacitor and circuit ground;

a direct current (DC) blocking capacitor coupled between the fourth output connection and circuit ground; and a first filament capacitor coupled in series with the first secondary winding of the resonant inductor, wherein the first filament capacitor and the first secondary winding are coupled in series between the first and second output connections; and a second filament capacitor coupled in series with the second secondary winding of the resonant inductor, wherein the second filament capacitor and the second secondary winding are coupled in series between the third and fourth output connections.

4. The ballast of claim 1, wherein the inverter comprises:

an input for receiving a source of substantially direct current (DC) voltage;

an inverter output terminal;

at least a first inverter switch; and an inverter driver circuit coupled to at least the first inverter switch and operable to commutate the first inverter switch at the operating frequency, the inverter driver circuit comprising:

a DC supply input for receiving operating power; and a voltage controlled oscillator (VCO) input, wherein the operating frequency is set in dependence upon a voltage provided to the VCO input.

5. The ballast of claim 4, wherein the inverter further comprises:

a startup circuit coupled to the source of substantially DC voltage and the DC supply input of the inverter driver circuit; and a bootstrap supply circuit coupled between the inverter output terminal and the DC supply input of the inverter driver circuit.

6. The ballast of claim 5, wherein the startup circuit comprises:

a startup resistor coupled between the source of substantially DC voltage and the DC supply input of the inverter driver circuit; and a supply capacitor coupled between the DC supply input of the inverter driver circuit and circuit ground.

7. The ballast of claim 5, wherein the bootstrap supply circuit comprises a charge-pump circuit.

8. The ballast of claim 5, wherein the bootstrap supply circuit comprises:

a coupling capacitor coupled to the inverter output terminal;

a first diode having an anode coupled to circuit ground and a cathode coupled to the coupling capacitor;

a second diode having an anode and a cathode, wherein the anode of the second diode is coupled to the cathode of the first diode; and a resistor coupled between the cathode of the second diode and the DC supply input of the inverter driver circuit.

9. The ballast of claim 4, wherein the control circuit comprises:

a voltage detection circuit coupled to the resonant output circuit, wherein the voltage detection circuit includes a detection output and is operable to provide: (i) a first detection signal at the detection output in response to the monitored voltage within the resonant output circuit reaching the first specified level; and (ii) a second detection signal at the detection output in response to the monitored voltage within the resonant output circuit reaching the second specified level;

a frequency-hold circuit coupled between the detection output of the voltage detection circuit and the VCO input of the inverter driver circuit, and operable: (i) in response to the first detection signal, to substantially maintain the voltage provided to the VCO input at a first value for the duration of the predetermined preheating period; and (ii) in response to the second detection signal, to substantially maintain the voltage provided to the VCO input at a second value for the duration of the predetermined ignition period; and a timing control circuit having at least a first output coupled to the frequency-hold circuit and operable to provide a preheat control signal at the first output upon completion of the preheating period.

10. The ballast of claim 9, wherein the voltage detection circuit further comprises:

a first diode having an anode and a cathode;

a second diode having an anode and a cathode, wherein the anode of the first diode is coupled to the cathode of the second diode, and the anode of the second diode is operably coupled to circuit ground; and a low-pass filter comprising:

a filter resistor coupled between the cathode of the first diode and the detection output; and a filter capacitor coupled between the detection output and circuit ground.

11. The ballast of claim 9, wherein the frequency-hold circuit comprises:

a first electronic switch having a base, a collector, and an emitter, wherein the emitter is coupled to circuit ground;

a second electronic switch having a gate, a drain, and a source, wherein the drain is coupled to the base of the first electronic switch, and the source is coupled to circuit ground;

a third electronic switch having a base, a collector, and an emitter, wherein the collector of the third electronic switch is coupled to the collector of the first electronic switch, and the emitter of the third electronic switch is coupled to circuit ground;

a pull-down resistor coupled between the VCO input of the inverter driver circuit and the collector of the first electronic switch;

a first resistor coupled between the detection output of the voltage detection circuit and the base of the first electronic switch;

a second resistor coupled between the base of the first electronic switch and circuit ground;

a third resistor coupled between the detection output of the voltage detection circuit and the base of the third electronic switch; and a fourth resistor coupled between the base of the third electronic switch and circuit ground.

12. The ballast of claim 11, wherein the frequency-hold circuit further comprises a zener diode coupled in parallel with the third resistor, wherein the zener diode has a cathode coupled to the detection output of the detection circuit and an anode coupled to the base of the third electronic switch.

13. The ballast of claim 11, wherein:

the first electronic switch comprises a NPN bipolar junction transistor;

the second electronic switch comprises a N-channel field-effect transistor; and the third electronic switch comprises a NPN bipolar junction transistor.

14. The ballast of claim 9, wherein the timing control circuit comprises a programmable microcontroller.

15. The ballast of claim 9, wherein:

the timing control circuit further comprises a second output and a third output;

the inverter driver circuit further comprises a frequency control input;

the control circuit further comprises:

an inverter shutdown circuit coupled between the third output of the timing control circuit and the DC supply input of the inverter driver circuit, and operable, in response to a shutdown control signal being provided at the third output of the timing control circuit, to deactivate the inverter driver circuit; and a lamp current control circuit coupled between the second output of the timing control circuit and the frequency control input of the inverter driver circuit, and operable, in response to a current control signal being provided at the second output of the timing control circuit, to effectuate a change in the operating frequency of the inverter.

16. The ballast of claim 15, wherein the inverter shutdown circuit is further operable, in response to termination of the shutdown control signal by the timing control circuit, to allow reactivation of the inverter driver circuit.

17. The ballast of claim 15, wherein the inverter shutdown circuit comprises:

an electronic switch having a gate, a drain, and a source, wherein the gate is coupled to the third output of the timing control circuit, and the source is coupled to circuit ground; and a pull-down resistor coupled between the DC supply input of the inverter driver circuit and the drain of the electronic switch.

18. The ballast of claim 15, wherein the lamp current control circuit comprises:

an electronic switch having a base, a collector, and an emitter, wherein the base is coupled to the second output of the timing control circuit, and the emitter is coupled to circuit ground;

a first resistor coupled between the frequency control input of the inverter driver circuit and the collector of the electronic switch;

a second resistor coupled between the second output of the timing control circuit and the base of the electronic switch; and a capacitor coupled between the base of the electronic switch and circuit ground.

19. A ballast for powering at least one gas discharge lamp having a pair of lamp filaments, the ballast comprising:

an inverter, comprising:

an input for receiving a source of substantially direct current (DC) voltage;

an inverter output terminal for providing an inverter output voltage having an operating frequency;

at least a first inverter switch; and an inverter driver circuit coupled to at least the first inverter switch and operable to commutate the first inverter switch at the operating frequency, the inverter driver circuit comprising:

a DC supply input for receiving operating power; and a voltage controlled oscillator (VCO) input, wherein the operating frequency is set in dependence upon a voltage provided to the VCO input;

a resonant output circuit coupled between the inverter output terminal and the lamp, and operable to provide: (i) preheating of the lamp filaments; (ii) an ignition voltage for igniting the lamp; and (iii) a magnitude-limited current for operating the lamp;

a control circuit coupled to the output circuit and the inverter, wherein the control circuit comprises:

a voltage detection circuit coupled to the resonant output circuit, wherein the voltage detection circuit includes a detection output and is operable to provide: (i) a first detection signal at the detection output in response to a monitored voltage within the resonant output circuit reaching a first specified level; and (ii) a second detection signal at the detection output in response to the monitored voltage within the resonant output circuit reaching a second specified level;

a frequency-hold circuit coupled between the detection output of the voltage detection circuit and the VCO input of the inverter driver circuit, and operable: (i) in response to the first detection signal, to substantially maintain the voltage provided to the VCO input at a first value for the duration of the predetermined preheating period; and (ii) in response to the second detection signal, to substantially maintain the voltage provided to the VCO input at a second value for the duration of the predetermined ignition period; and a timing control circuit having at least a first output coupled to the frequency-hold circuit and operable to provide a preheat control signal at the first output upon completion of the preheating period.

20. The ballast of claim 19, wherein the resonant output circuit comprises:

first and second output connections adapted for coupling to a first filament of the lamp;

third and fourth output connections adapted for coupling to a second filament of the lamp;

a resonant inductor, comprising a primary winding, a first secondary winding, and a second secondary winding, wherein the primary winding is coupled between the inverter and the second output connection;

a resonant capacitor coupled to the second output connection;

a voltage-divider capacitor coupled between the resonant capacitor and circuit ground;

a direct current (DC) blocking capacitor coupled between the fourth output connection and circuit ground; and a first filament capacitor coupled in series with the first secondary winding of the resonant inductor, wherein the first filament capacitor and the first secondary winding are coupled in series between the first and second output connections; and a second filament capacitor coupled in series with the second secondary winding of the resonant inductor, wherein the second filament capacitor and the second secondary winding are coupled in series between the third and fourth output connections.

21. The ballast of claim 19, wherein the voltage detection circuit further comprises:

a first diode having an anode and a cathode;

a second diode having an anode and a cathode, wherein the anode of the first diode is coupled to the cathode of the second diode, and the anode of the second diode is operably coupled to circuit ground; and a low-pass filter comprising:

a filter resistor coupled between the cathode of the first diode and the detection output; and a filter capacitor coupled between the detection output and circuit ground.

22. The ballast of claim 19, wherein the frequency-hold circuit comprises:

a first electronic switch having a base, a collector, and an emitter, wherein the emitter is coupled to circuit ground;

a second electronic switch having a gate, a drain, and a source, wherein the drain is coupled to the base of the first electronic switch, and the source is coupled to circuit ground;

a third electronic switch having a base, a collector, and an emitter, wherein the collector of the third electronic switch is coupled to the collector of the first electronic switch, and the emitter of the third electronic switch is coupled to circuit ground;

a pull-down resistor coupled between the VCO input of the inverter driver circuit and the collector of the first electronic switch;

a first resistor coupled between the detection output of the voltage detection circuit and the base of the first electronic switch;

a second resistor coupled between the base of the first electronic switch and circuit ground;

a third resistor coupled between the detection output of the voltage detection circuit and the base of the third electronic switch; and a fourth resistor coupled between the base of the third electronic switch and circuit ground.

23. The ballast of claim 19, wherein the timing control circuit comprises a programmable microcontroller.

24. A ballast for powering at least one gas discharge lamp having a pair of lamp filaments, the ballast comprising:

an inverter, comprising:

an input for receiving a source of substantially direct current (DC) voltage;

an inverter output terminal for providing an inverter output voltage having an operating frequency;

at least a first inverter switch; and an inverter driver circuit coupled to at least the first inverter switch and operable to commutate the first inverter switch at the operating frequency, the inverter driver circuit comprising:

a DC supply input for receiving operating power; and a voltage controlled oscillator (VCO) input, wherein the operating frequency is set in dependence upon a voltage provided to the VCO input;

a resonant output circuit, comprising:

first and second output connections adapted for coupling to a first filament of the lamp;

third and fourth output connections adapted for coupling to a second filament of the lamp;

a resonant inductor, comprising a primary winding, a first secondary winding, and a second secondary winding, wherein the primary winding is coupled between the inverter and the second output connection;

a resonant capacitor coupled to the second output connection;

a voltage-divider capacitor coupled between the resonant capacitor and circuit ground;

a direct current (DC) blocking capacitor coupled between the fourth output connection and circuit ground; and a first filament capacitor coupled in series with the first secondary winding of the resonant inductor, wherein the first filament capacitor and the first secondary winding are coupled in series between the first and second output connections; and a second filament capacitor coupled in series with the second secondary winding of the resonant inductor, wherein the second filament capacitor and the second secondary winding are coupled in series between the third and fourth output connections; and a control circuit, comprising:

a voltage detection circuit, comprising:

a detection output;

a first diode having an anode and a cathode;

a second diode having an anode and a cathode, wherein the anode of the first diode is coupled to the cathode of the second diode, and the anode of the second diode is operably coupled to circuit ground; and a low-pass filter comprising:

a filter resistor coupled between the cathode of the first diode and the detection output; and a filter capacitor coupled between the detection output and circuit ground;

a frequency-hold circuit, comprising:

a first electronic switch having a base, a collector, and an emitter, wherein the emitter is coupled to circuit ground;

a second electronic switch having a gate, a drain, and a source, wherein the drain is coupled to the base of the first electronic switch, and the source is coupled to circuit ground;

a third electronic switch having a base, a collector, and an emitter, wherein the collector of the third electronic switch is coupled to the collector of the first electronic switch, and the emitter of the third electronic switch is coupled to circuit ground;

a pull-down resistor coupled between the VCO input of the inverter driver circuit and the collector of the first electronic switch;

a first resistor coupled between the detection output of the voltage detection circuit and the base of the first electronic switch;

a second resistor coupled between the base of the first electronic switch and circuit ground;

a third resistor coupled between the detection output of the voltage detection circuit and the base of the third electronic switch; and a fourth resistor coupled between the base of the third electronic switch and circuit ground; and a timing control circuit, comprising at least a first output coupled to the second electronic switch of the frequency-hold circuit.

* * * * *